United States Patent [19]

Piper

[11] 4,013,318

[45] Mar. 22, 1977

[54] PORTABLE FOOTREST

[76] Inventor: James G. Piper, P.O. Box 103, Park City, Utah 84060

[22] Filed: Feb. 25, 1976

[21] Appl. No.: 658,347

[52] U.S. Cl. ..... 297/438; 297/437

[51] Int. Cl.[2] ..... A47C 7/50

[58] Field of Search ..... 105/329 SC; 297/423, 297/437, 438

[56] References Cited

UNITED STATES PATENTS

| | | | |
|---|---|---|---|
| 402,130 | 4/1889 | Bedford | 297/438 X |
| 1,216,730 | 2/1917 | Quiggle | 297/423 X |
| 2,467,252 | 4/1949 | Brandon | 297/423 X |
| 3,674,111 | 7/1972 | Weissberg | 105/329 SC X |

*Primary Examiner*—James C. Mitchell
*Attorney, Agent, or Firm*—Mallinckrodt & Mallinckrodt

[57] ABSTRACT

A portable footrest, adapted to be used with a chair, such as used on ski chairlifts, comprises a foot support member which is adapted for suspension from the forward edge of the seat portion of the chair by a flexible, suspension member. One end of the suspension member is attached to the footrest, and means are associated with the other end thereof for attaching the other end of the suspension member to the chair.

10 Claims, 5 Drawing Figures

FIG. 1.
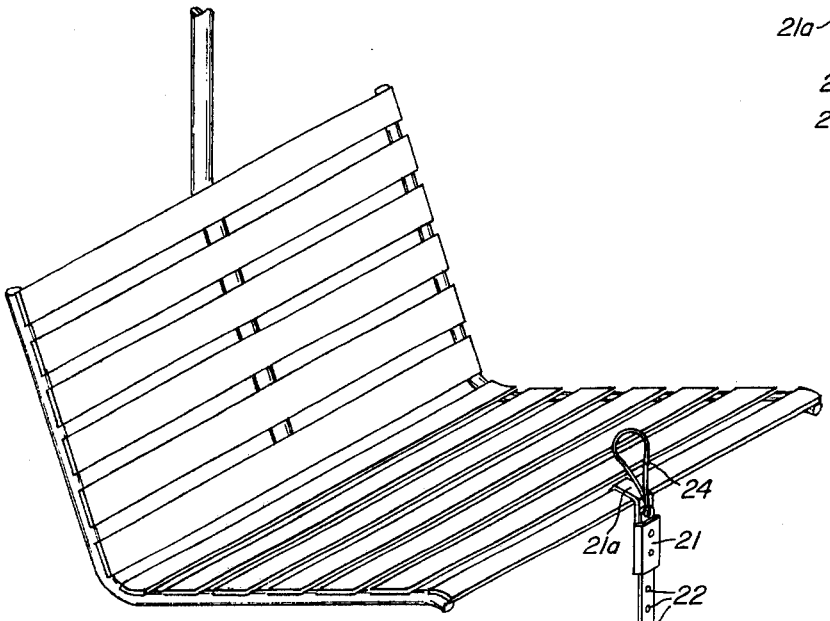
FIG. 5.
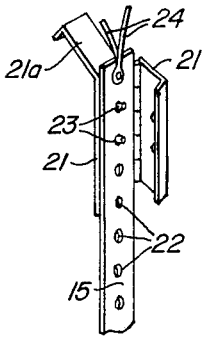
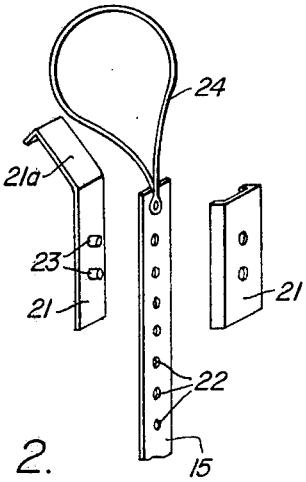
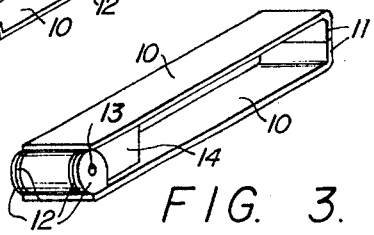
FIG. 3.
FIG. 2.
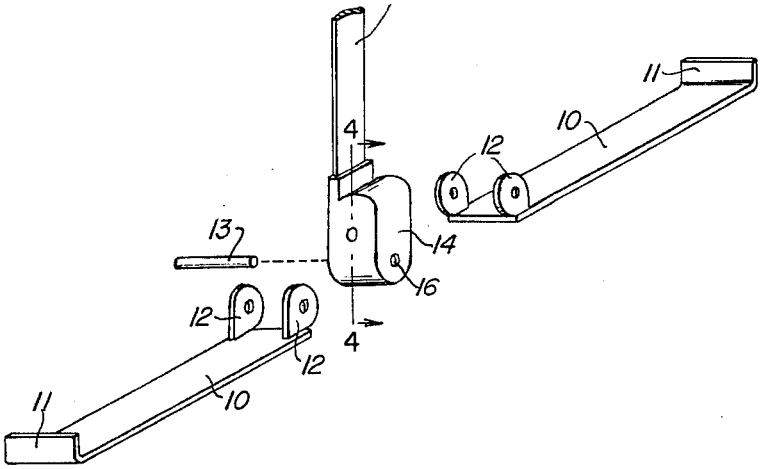
FIG. 4.
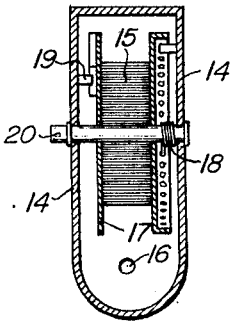

PORTABLE FOOTREST

BACKGROUND OF THE INVENTION

1. Field

This invention pertains to footrests for chairs, and more particularly to portable footrests which are readily attached to and removed from chairs used on a ski chairlift.

2. State of the Art

Footrests are provided on various type chairs, such as on barber's chairs and dentist's chairs. Such footrests are of the type which are permanently attached to the chair. In many instances, it would be convenient to have a portable footrest which could be quickly attached to and removed from a chair. For example, many chairlifts which are used at ski resort areas to carry skiers from the lower end of a ski run to the higher end are not provided with footrests. A portable footrest, which could be carried in the pocket of the skier's clothing, and, which could readily be attached to and removed from the chairlift, would be of great help in alleviating the skier's legs of the weight of the boots, bindings and skis during the ride on the chairlift.

In U.S. Pat. No. 402,130, an adjustable, portable footrest is disclosed for use with bench type seats used on trains. The footrest comprises a pair of hook members which are placed over the top back edge of the seat or bench in front of the seat which is to be occupied by the user of the footrest. Straps hang down from the hooks, and stirrups are attached at the lower end of the straps to accomodate the feet of the user. Such a footrest is not adaptable for use on isolated chairs or on ski chairlifts where the chairs are spaced at a considerable distance from each other. In addition, the footrest disclosed in U.S. Pat. No. 402,130, is awkward to use, and it could not be readily carried in the pocket of the user's clothing during periods when it is not being used.

SUMMARY OF THE INVENTION

A portable footrest is provided which can readily be attached to and removed from a chair. The footrest is advantageously adapted to be used by skiers on chairlifts in which the chairs of the lift have no footrests incorporated therewith. The footrest of this invention is simple to use and can be collapsed and folded into a very compact item. Skiers can readily insert the footrest into a pocket of their ski jackets while they are skiing, whereby the footrest is always available for subsequent rides on the ski chairlift. By using the footrest, a skier avoids strain on his legs which would otherwise result from supporting the weight of the skis, bindings and boots. The rest which the legs receive alleviates leg fatique, thereby resulting in safer and more comfortable skiing.

The footrest of this invention comprises a foot support member and a flexible, suspension member. Means are provided for attaching one end of the suspension member to the foot support member at a point intermediate its ends, and the other end of the suspension member is provided with means for being attached to a chair so that the foot support member is suspended from the forward edge of the seat of the chair.

In use, the skier, or anyone desiring to rest their feet and legs as they sit in a chair, attaches the free end of the suspension member to the chair seat so that the foot support member is suspended between the user's legs. Then, the user simply lifts his legs and puts his feet on the foot support member. When the user desires to get out of the chair, he simply raises his feet from the foot support member and detaches the suspension member from the chair. The footrest device can then be folded into a compact item to be carried with the user for use at a subsequent time.

Preferably, the foot support member comprises two pieces having mutually adjacent ends pivotally connected together so that the two pieces are movable about their mutual ends from a closed position in which they are folded upon each other in essentially parallel, side-by-side relationship, to an open, operable position in which they extend outwardly in opposite directions from their mutual ends. The suspension member is attached by appropriate means to the two-piece foot support member so that the two pieces thereof are suspended from their mutual ends.

The suspension member preferably comprises an elongate, metal tape, such as that used in retractable tape measures. One end of the tape is attached to the drum and the tape wound or unwound from the rotatable drum in the fashion of a tape measure. The rotatable drum is supported within a housing, and the housing is pivotally attached to the foot support member.

In an advantageous arrangement, the two pieces of the foot support member are connected together by hinge means comprising at least two upstanding lugs positioned at each of the mutual ends of the two pieces of the foot support member. The lugs have respective openings which are aligned on a common axis, and a hinge pin extends through the openings. The housing of the drum and retractable tape is mounted on the hinge pin for pivotal movement thereabout. This embodiment of the footrest device can be folded into a very compact item, wherein the tape is wound on the drum inside the housing, and the two pieces of the foot support member fold up around the housing. When the device is to be used as a footrest, the foot support members are unfolded to their operable position, and the tape is pulled out to its maximum length with the free end thereof being attached to the chair.

The tape drum advantageously is spring biased and provided with a locking device so that the tape can be withdrawn and held in the withdrawn position by the locking device. When the locking device is released, the tape is then automatically rewound on the drum due to the spring bias which is applied thereto.

The means for attaching the free end of the tape to the chair preferably comprises an attachment member which is removably secured to the free end of the tape, and which is further adapted to be removably secured to the chair. For example, the attachment member may comprise a two-piece clamp which clamps over the tape. To insure locking engagement and a means for effectively varying the working length of the tape, a series of openings are positioned along the tape near the free end thereof, and one piece of the two-piece clamp has two pegs projecting therefrom which are adapted to fit through any two adjacent openings in the tape. The second piece of the clamp is adapted to clamp to the first piece so as to securely hold the tape therebetween.

THE DRAWINGS

An embodiment representing the best mode presently contemplated of carrying out the novel concepts of the invention in actual practice is illustrated in the accompanying drawings, in which:

FIG. 1 is a pictorial view of the device of this invention as it is used on a ski chairlift;

FIG. 2, an exploded perspective view showing how the parts of the illustrated embodiment of the invention are assembled;

FIG. 3, a perspective view of the assembled device of FIG. 2, shown in its compact, folded form;

FIG. 4, a vertical section taken on line 4—4 of FIG. 2; and

FIG. 5, a pictorial view of a preferred form of a hinged clamp according to the invention.

DETAILED DESCRIPTION OF THE ILLUSTRATED EMBODIMENTS

In accordance with the invention, a portable footrest device is provided which is adapted to be quickly and easily attached to and removed from a chair, such as those used on ski chairlifts. The footrest device is also adapted to be folded into a small, compact item, which the skier upon disembarking the ski chairlift, can carry in the pocket of his parka or ski jacket so that the footrest can be used once again on subsequent rides up the chairlift.

The portable footrest comprises a foot support member, which as illustrated in the drawings consists of two, essentially flat bar members 10 which have mutually adjacent ends pivotally connected together so that the two bar members 10 are movable about their mutual ends from a closed position in which they are folded upon each other in essentially parallel, side-by-side relationship (FIG. 3), to an open, operable position (FIGS. 1 and 2) in which they extend outwardly in opposite directions from their mutual ends. As illustrated, the free ends of the bar members 10 are bent to form upturned flanges 11, which serve to prevent the skis of the user from slipping free of the footrest. The mutual ends of bar members 10 are connected together by hinge means comprising at least two upstanding lugs 12 positioned at each of the mutual ends. The lugs 12 have respective openings therein which are aligned on a common axis, and a hinge pin 13 extends through the openings.

The lugs 12 are positioned so that the bar members 10 can be rotated about the hinge pin 13 from a position as shown in FIG. 3 wherein the bar members are folded upon each other in essentially parallel, side-by-side relationship, to an open, operable position as shown in FIGS. 1 and 2, wherein the bar members 10 extend outwardly in opposite directions from the hinge means. A housing 14 containing an extendible steel tape 15 is mounted between the pairs of lugs 12 on the bar members 10. The housing 14 is held in place for pivotal movement about hinge pin 13 which extends through aligned openings 16 (FIGS. 2 and 4) in the opposite sides of the housing 14. As shown in FIG. 4, a rotatable drum 17 is supported within the housing 14. One end of the steeltape 15 is attached to the drum 17, and the tape is adapted to be wound upon drum 17 in the manner of a retractable, steel tape measure. The drum 17 is spring biased and provided with a locking device so that the tape 15 can be withdrawn from the drum 17 and held in the withdrawn position by the locking device. The spring biasing is provided by a conventional coil spring 18 (FIG. 4). The locking device is the same as used in retractable steel tape measures, except that locking need only be effected when the tape 15 has been fully unwound from the drum 17. As shown in FIG. 4, a ratchet type mechanism 19 is adapted to engage the drum 17 when the tape 15 has been fully unwound thereform. A release button 20 is provided for releasing the locking device thereby allowing the tape 15 to be rewound on drum 17.

Means are provided for removably attaching the free end of the tape 15 to the edge of a chair. As illustrated, such means comprises a two-piece clamp 21 which is adapted to removably attach to the tape 15 at various preset positions along the tape 15 near the free end thereof. The two pieces of clamp 21 are preferably hinged together along one mutual set of sides (FIG. 5) and adapted to be closed together with the tape positioned therebetween. To prevent movement of the tape 15 relative to clamp 21, the steel tape 15 is provided with a series of openings 22 therealong, and one piece of the clamp 21 has two pegs 23 projecting therefrom which are adapted to fit through any two adjacent openings in the tape 15. The second piece of clamp 21, as shown, has two openings therein which are adapted to receive the pegs 23 of the first piece when the clamp 21 is closed.

The clamp 21 also has a curved, hook section **21*a* which is adapted to hook over one of the slats of a chair having the seat portion thereof made of slats (see FIG. 1). Other means of holding the free end of the tape 15** to the chair can be used for chairs which are not made with slats. Such means could comprise a small piece of cloth having a hook member extending therefrom. The piece of cloth is placed on the chair seat with the hook member close to the forward edge of the seat. The user then sits in the chair on the piece of cloth and hooks the hook member of the footrest device to the corresponding hook of the piece of cloth. In addition, the means could comprise a hooked end adapted to fit around the forward support bar of the ski lift chair.

A safety strap 24 is advantageously attached to the free end of the tape 15. The strap 24 comprises a flexible strap whose two ends are attached to the free end of the tape 15 so that the strip forms a flexible, closed loop. When the footrest device is being used, the strap 24 is placed around the arm of the user. If the hook section **21*a* on clamp 21 comes loose, the strap 24 prevents loss of the footrest device. In addition, the strap 24** prevents loss of the footrest device when the user gets up from and leaves the chair in which he was sitting.

The device which is illustrated can be folded up into a very compact form as shown in FIG. 3. The tape 15 is wound on the drum 17 in housing 14, and the two flat bar members 10 are folded together until the flanges 11 contact each other. The housing 14, the clamp 21, and the strap 24 are contained neatly between the two flat bar members 10. If a piece of cloth is used as explained hereinbefore for holding the free end of tape 15 to the chair when the footrest is being used, the cloth is advantageously formed into a pouch in which the folded device as shown in FIG. 2 could be inserted for protective storage when it is not being used.

Whereas there is here described a certain preferred device which is presently regarded as embodying the best mode of carrying out the invention, it should be understood that various changes may be made and other modifications adopted without departing from the disclosed inventive concepts particularly pointed out in the following claims.

I claim:

1. A portable footrest adapted to be used with a chair in which the user of the footrest is sitting, comprising an integral foot support member, said foot support member comprising two pieces having mutually adjacent ends pivotally connected together as a unit so that the two pieces are movable about their interconnected mutual ends from a closed position in which they are folded upon each other in essentially parallel, side-by-side relationship to an open, operable position in which they extend outwardly in opposite directions from their interconnected mutual ends; a flexible suspension member; means for attaching one end of said suspension member to said foot support member at a point intermediate its ends so that the two pieces thereof are suspended from their interconnected mutual ends; and means for attaching the other end of said suspension member to said chair.

2. A portable footrest in accordance with claim 1, wherein the suspension member comprises an elongate tape, and the means for attaching the suspension member to the foot support member comprises a rotatable drum to which one end of said tape is attached and upon which the tape can be wound and unwound; and a support and housing means for said drum, said support and housing means being pivotally attached to the foot support member.

3. A portable footrest in accordance with claim 2, wherein the two pieces of said foot support member are connected together by hinge means comprising at least two upstanding lugs positioned at each of the mutual ends of said pieces, said lugs having respective openings which are aligned on a common axis; and a hinge pin which extends through said openings.

4. A portable footrest in accordance with claim 3, wherein the support and housing means of said suspension member is mounted to the hinge pin of said hinge means for pivotal movement thereabout.

5. A portable footrest in accordance with claim 2, wherein the rotatable drum is spring biased and provided with a locking device, so that the tape can be withdrawn from the drum and held in the withdrawn position by the locking device, and when the locking device is released, the tape is rewound on said drum thereby returning the tape to an unextended position.

6. A portable footrest in accordance with claim 2, wherein the means for attaching the other end of the tape to the chair comprises an atttachment member adapted to be removably secured to the elongate tape, said attachment member also having a hooked extension thereform which is adapted to be secured to said chair.

7. A portable footrest in accordance with claim 6, wherein the two ends of a safety strap are attached to the other end of said tape so that the strap forms a flexible, closed loop.

8. A portable footrest in accordance with claim 6, wherein the tape has a series of openings therealong near the other end thereof and the attachment member comprises a two-piece clamp, one piece having two pegs projecting therefrom which are adapted to fit through any two adjacent openings in said tape, and the second piece adapted to clamp to the first piece with the tape positioned between the two pieces.

9. A portable footrest in accordance with claim 8, wherein the first and second pieces are hinged together along mutual sides and are adapted to be closed together with the tape positioned therebetween.

10. A portable footrest in accordance with claim 1, in combination with a ski chairlift.

* * * * *